US011801682B2

(12) United States Patent
Osawa

(10) Patent No.: US 11,801,682 B2
(45) Date of Patent: Oct. 31, 2023

(54) IMAGE FORMER

(71) Applicant: Konica Minolta, Inc., Tokyo (JP)

(72) Inventor: Satoru Osawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 61 days.

(21) Appl. No.: 17/388,456

(22) Filed: Jul. 29, 2021

(65) Prior Publication Data

US 2022/0055371 A1 Feb. 24, 2022

(30) Foreign Application Priority Data

Aug. 18, 2020 (JP) ..... 2020-137936

(51) Int. Cl.
*B41J 2/175* (2006.01)

(52) U.S. Cl.
CPC ..... *B41J 2/17556* (2013.01); *B41J 2/17513* (2013.01); *B41J 2/17526* (2013.01); *B41J 2/17566* (2013.01)

(58) Field of Classification Search
CPC ..... B41J 2/17556; B41J 2/17513; B41J 2/17526; B41J 2/17566; B41J 2/19; B41J 29/38
USPC ..... 347/86
See application file for complete search history.

(56) References Cited

U.S. PATENT DOCUMENTS

2008/0273064 A1* 11/2008 Ota ..... B41J 2/17556 347/85
2010/0259587 A1* 10/2010 Uptergrove ..... B41J 2/18 347/85

FOREIGN PATENT DOCUMENTS

JP 2008-000962 A 1/2008
JP 2009-285845 A 12/2009

* cited by examiner

*Primary Examiner* — Matthew Luu
*Assistant Examiner* — Alexander D Shenderov
(74) *Attorney, Agent, or Firm* — LUCAS & MERCANTI, LLP

(57) ABSTRACT

An image former includes: an inkjet head; a plurality of ink storages that is connected to the inkjet head and stores ink; a pressure generator that generates a difference in internal pressure between the plurality of ink storages so that ink flows between the plurality of ink storages and the inkjet head; and a storage communicator that causes the plurality of ink storages to communicate with each other so that the difference in internal pressure decreases.

4 Claims, 5 Drawing Sheets

IMAGE FORMER

The entire disclosure of Japanese patent Application No. 2020437936, filed on Aug. 18, 2020, is incorporated herein by reference in its entirety.

BACKGROUND

Technological Field

The present invention relates to an image former.

Description of the Related Art

Conventionally, there has been known an inkjet image former (hereinafter, referred to as an image former) that forms (records) an image on a recording medium, which is conveyed by a conveyance device, by ejecting ink from a plurality of nozzles provided in an inkjet head.

Some image formers include a supply tank that supplies ink, an inkjet head, and an ink supply mechanism that supplies ink to the inkjet head while circulating ink with a collection tank that collects ink (refer to JP 2008-962 A and JP 2009-285845 A, for example).

In the above-described ink supply mechanism, the supply tank that supplies ink to the inkjet head and the inkjet head are connected via an ink supply path. Back pressure (negative pressure for meniscus) is applied to the supply tank, and appropriate meniscus pressure is formed at an ejection port of the inkjet head by the back pressure. By appropriately controlling the meniscus pressure, a meniscus having an appropriate shape can be formed at the ejection port of the inkjet head.

In the ink supply mechanism, back pressure (negative pressure) having a magnitude different from a magnitude of back pressure of the supply tank is also applied to the collection tank that collects ink from the inkjet head. A difference in internal pressure (back pressure difference) between the supply tank and the collection tank guides ink, which is supplied to the inkjet head, to the collection tank via an ink collection path. A flow rate of ink flowing to the inkjet head is adjusted by a difference in internal pressure between the supply tank and the collection tank.

Here, a configuration in which back pressure is applied to the supply tank and the collection tank will be described. Aback pressure pump is connected to each of the supply tank and the collection tank via an air flow path. Then, as a result of back pressure having different magnitudes is applied to the supply tank and the collection tank by drive control of the back pressure pump, a difference, in internal pressure is generated between the supply tank and the collection tank, and ink flows from the supply tank to the collection tank via the inkjet head.

However, the difference in internal pressure remains between the supply tank and the collection tank in the above-described ink supply mechanism in a case of an unexpected stop of the image former (that is, a stop of drive control of back pressure pump), such as an emergency stop of the image former or an instantaneous power interruption (a power failure for a short time). As a result, there has been a problem that the difference in internal pressure may cause a failure such as, for example, ink flowing out from the supply tank (or the collection tank) to the air flow path or ink leaking from a nozzle provided on the inkjet head.

SUMMARY

An object of the present invention is to provide an image former capable of preventing occurrence of a failure caused by an unexpected stop of the image former.

To achieve the abovementioned object, according to an aspect of the present invention, an image former reflecting one aspect of the present invention comprises: an inkjet head; a plurality of ink storages that is connected to the inkjet head and stores ink; a pressure generator that generates a difference in internal pressure between the plurality of ink storages so that ink flows between the plurality of ink storages and the inkjet head; and a storage communicator that causes the plurality of ink storages to communicate with each other so that the difference in internal pressure decreases.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
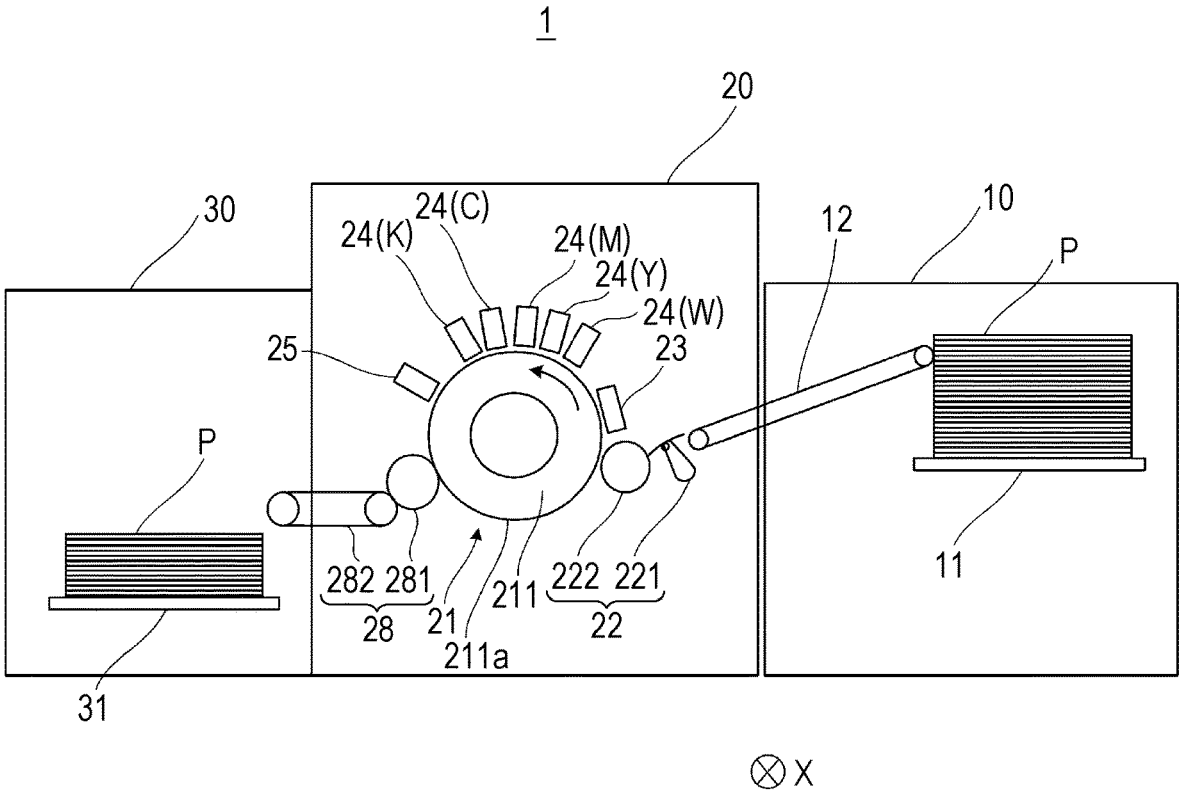
FIG. 1 is a diagram showing a schematic configuration of an inkjet image former.

FIG. 1 is a diagram showing a schematic configuration of an inkjet image former 1. The inkjet image former 1 includes a paper feeder 10, an image formation unit 20, a paper ejector 30, and a controller 40 (refer to FIG. 3).

Under control of the controller 40, the inkjet image former 1 (functioning as an "image former" of the present invention) conveys a recording medium P stored in the paper feeder 10 to the image formation unit 20, forms an image on the recording medium P with the image formation unit 20, and conveys the recording medium P on which the image is finned to the paper ejector 30. As the recording medium P, various media capable of fixing ink landed on a surface thereof, such as cloth or sheet-shaped resin, can be used in addition to paper such as plain paper or coated paper.

The paper feeder 10 includes a paper feed tray 11 that stores the recording medium P, and a medium supplier 12 that conveys and supplies the recording medium P from the paper feed tray 11 to the image formation unit 20. The medium supplier 12 includes an annular belt of which inside is supported by two rollers. The medium supplier 12 conveys the recording medium P from the paper feed tray 11 to the image formation unit 20 by rotating the rollers in a state where the recording medium P is placed on the belt.

The image formation unit 20 includes a conveyor 21, a transfer unit 22, a heater 23, a head unit 24, a fixer 25, a deliverer 28, or the like.

The conveyor 21 holds the recording medium P placed on a conveyance surface 211*a* (a placement surface) of a conveyance drum 211 having a cylindrical shape. By the conveyance drum 211 rotating in a circular movement around a rotary shaft (a cylindrical shaft) extending in an X direction (a direction perpendicular to a paper surface in FIG. 1), the conveyor 21 conveys the recording medium P on the conveyance drum 211 in a conveyance direction (a Y direction).

The conveyance drum 211 includes a claw and an air inlet, which are not illustrated, for holding the recording medium P on the conveyance surface 211*a*. The recording medium P is held on the conveyance surface 211*a* by an edge of the recording medium P being fastened by the claw and being drawn to the conveyance surface 211*a* by the air inlet. The conveyor 21 is connected to a conveyance drum motor (not illustrated) for rotating the conveyance drum 211. The conveyance drum 211 rotates by an angle proportional to a rotation rate of the conveyance drum motor.

The transfer unit 22 transfers, to the conveyor 21, the recording medium P conveyed by the medium supplier 12 of the paper feeder 10. The transfer unit 22 is provided at a position between the medium supplier 12 of the paper feeder 10 and the conveyor 21, holds and picks up one edge of the recording medium P conveyed from the medium supplier 12 by a swing arm 221, and transfers the recording medium P to the conveyor 21 via a transfer drum 222.

The heater 23 is provided between an arrangement position of the transfer drum 222 and an arrangement position of the head unit 24, and heats the recording medium P so that the recording medium P conveyed by the conveyor 21 has temperature that falls within a predetermined temperature range. The heater 23 includes, for example, an infrared heater or the like, and energizes the infrared heater on the basis of a control signal supplied front the controller 40 (refer to FIG. 3) to cause the infrared heater to generate heat.

The head units 21 ejects ink onto the recording medium P from a nozzle opening provided on an ink ejection surface facing the conveyance surface 211*a* of the conveyance drum 211 at an appropriate timing according to a rotation of the conveyance drum 211 holding the recording medium P to form an image. The head unit 24 is arranged such that the ink ejection surface and the conveyance surface 211*a* are separated from each other by a predetermined distance.

In the inkjet image former 1 according to the present embodiment, four head units 24 corresponding to inks of respective four colors of white (W), yellow (Y), magenta (M), cyan (C), and black (K) are arranged at predetermined intervals in an order of colors of W, Y, M, C, and K from an upstream in the conveyance direction of the recording medium P.

Figure 2:
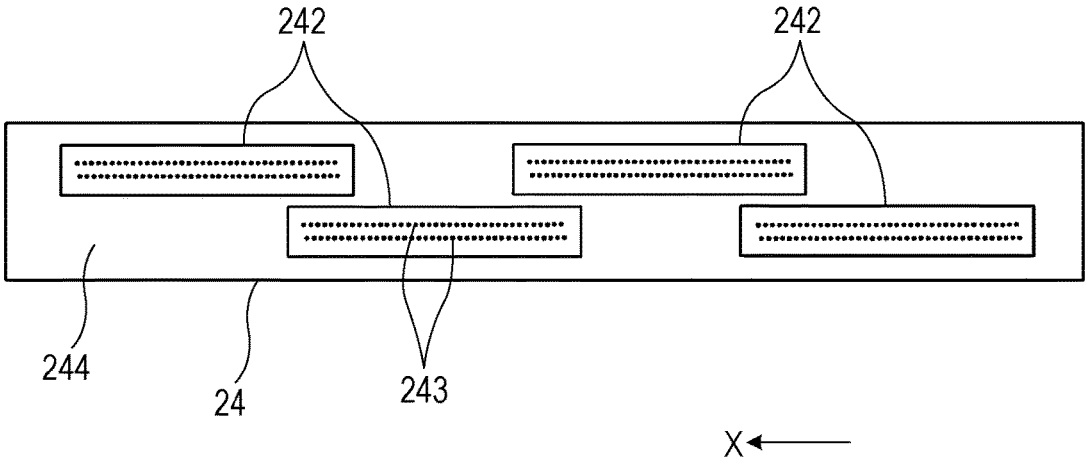
FIG. 2 is a schematic diagram showing a configuration of a head unit.

FIG. 2 is a schematic diagram showing a configuration of a head unit 24. Here, a surface of the head unit 24 is shown, the surface facing the conveyance surface 211*a* of the conveyance drum 211.

The head unit 21 includes four inkjet heads 242 attached to an attachment 244. Each of the inkjet heads 242 is provided with a plurality of image forming devices (recording devices) each including a pressure chamber that stores ink, a piezoelectric device provided on a wall surface of the pressure chamber, and a nozzle 213. In the image forming devices, when a drive signal for deforming the piezoelectric device is input, the pressure chamber is deformed by deformation of the piezoelectric device, pressure in the pressure chamber changes, and ink is ejected from the nozzle communicating with the pressure chamber.

In each of the inkjet heads 242, there are formed two nozzle rows including nozzles 243 arranged at equal intervals in a direction (In the present embodiment, a direction orthogonal to the conveyance direction, that is, the X direction) intersecting the conveying direction of the recording medium P. These two nozzle rows are provided such that the arrangement positions of the nozzles 243 are shifted from each other in the X direction by ½ of the arrangement interval of the nozzles 243 in each of the nozzle rows.

The four inkjet heads 242 are arranged in a staggered pattern such that arrangement areas of the nozzle rows in the X direction are seamlessly connected. The arrangement areas of the nozzles 243 included in the head unit 24 in the X direction cover a width in the X direction of an area on which an image is formed, the area being in the recording medium P conveyed by the conveyor 21. When an image is formed, the head unit 24 is used with a position thereof being fixed to the rotary shaft of the conveyance drum 211. That is, the head unit 24 includes a line head capable of ejecting ink across a width in which image formation is possible in the X direction with respect to the recording medium P. The inkjet image former 1 is an inkjet image former of a single pass type.

Note that the inkjet head 242 may include one, or three or more nozzle rows, instead of two nozzle rows. In addition, the head unit 24 may include three or less, or five or more inkjet heads 242, instead of four inkjet heads 242.

As ink ejected from the nozzles 243 of the image forming devices, ink including pigment is used. For example, white ink including titanium dioxide, or the like, as the pigment is included. Furthermore, as ink ejected from the nozzles 243 of the image forming devices, gel ink is used. The gel ink includes a gelling agent, and has a property of changing in phase to a gel state or sol state depending on temperature, and of curing by irradiation with an energy ray such as an ultraviolet ray. In the present embodiment, gel ink is used as the ink ejected from the nozzles 243 of the image forming devices.

Each of the head unit 24 includes an ink heater (not illustrated) that heats ink stored in the head unit 24. The ink heater operates under control of the controller 40 and heats ink to a temperature at which the ink turns into a sol.

Each of the inkjet head 242 ejects the ink heated to be in the sol state. When the ink in the sol state is ejected onto the recording medium P, an ink droplet lands on the recording medium P and then is naturally cooled, by which the ink quickly turns into a gel and solidifies on the recording medium P.

The fixer 25 includes a light emitter arranged across a width of the conveyor 21 in the X direction. The fixer 25 irradiates the recording medium P placed on the conveyor 21 with an energy ray, such as an ultraviolet ray, from the light emitter to cure and fix the ink (gel ink) ejected on the recording medium P. Facing the conveyance surface 211*a*, the light emitter of the fixer 25 is arranged at a position between the arrangement position of the head units 24 and an arrangement position of a transfer drum 281 of the deliverer 28 in the conveyance direction.

The deliverer 28 includes the transfer drum 281 that has a cylindrical shape and transfers the recording medium P from the conveyor 21 to a belt loop 282, and the belt loop 282 having an annular belt of which inside is supported by two rollers. The deliverer 28 conveys the recording medium P transferred from the conveyor 21 onto the belt loop 282 by the transfer drum 281, and delivers the recording medium P with the belt loop 282 to the paper ejector 30.

The paper ejector 30 includes a paper ejection tray 31 having a plate shape. The recording medium P sent from the image formation unit 20 by the deliverer 28 is placed onto the paper ejection tray 31.

Figure 3:
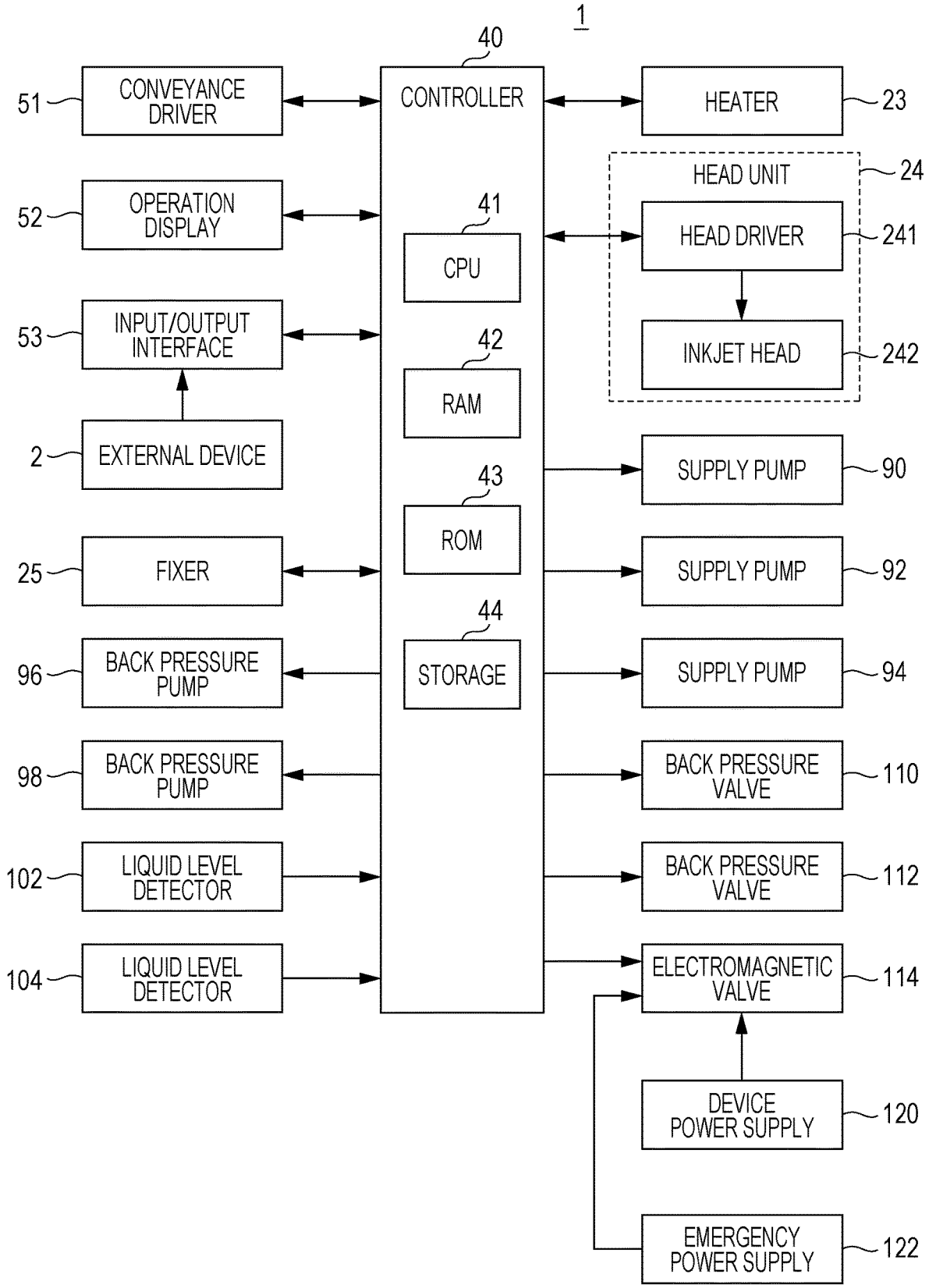
FIG. 3 is a block diagram showing a main functional configuration of the inkjet image former.

FIG. 3 is a block diagram showing a main functional configuration of the inkjet image former 1. The inkjet image former 1 includes the heater 23, head drivers 241 and inkjet heads 242, the fixer 25, the controller 40, a conveyance driver 51, an operation display 52, an input/output interface 53, or the like.

The head drivers 241 supply the image forming device in the respective inkjet heads 242 with a drive signal for deforming the piezoelectric device at an appropriate timing according to image data, thereby causing the nozzles 243 of the inkjet heads 242 to eject ink awl amount corresponding to a pixel value of the image data.

The controller 40 includes a central processing unit (CPU) 41, a random access memory (RAM) 42, a read only memory (ROM) 43, and a storage 44.

The CPU 41 reads various control programs or control setting data stored in the ROM 13, stores the control programs in the RAM 42, and executes the control programs to perform various arithmetic processing. The CPU 41 integrally controls entire operation of the inkjet image former 1.

The RAM 42 provides the CPU 41 with working memory space and stores temporary data. The RAM 42 may include a nonvolatile memory.

The ROM 43 stores the various control programs, control setting data, or the like executed by the CPU 41. Instead of the ROM 43, a rewritable nonvolatile memory, such as an electrically erasable programmable read only memory (EEPROM) or a flash memory, may be used.

The storage 44 stores a print job (image formation command) input from an external device 2 via the input/output interface 53, image data related to the print job, or the like. The print job includes information related to a type of the recording medium P on which an image is formed (for example, a size or thickness of the recording medium P), in addition to information specifying image data related to the image to be formed. A hard disk drive (HDD) may be used as the storage 44, for example, and a dynamic random access memory (DRAM), or the like may be used in combination with the storage 44.

The conveyance driver 51 supplies a drive signal to the conveyance drum motor of the conveyance drum 211 on the basis of a control signal supplied front the controller 40 to rotate the conveyance drum 211 at a predetermined rate and timing.

In addition, the conveyance driver 51 supplies a drive signal to a motor for operating the medium supplier 12, the transfer unit 22, and the deliverer 28 on the basis of a control signal supplied from the controller 40, and causes the medium supplier 12, the transfer unit 22, and the deliverer 28 to supply the recording medium P to the conveyor 21 and eject the recording medium P from the conveyor 21.

The operation display 52 includes a display device such as a liquid crystal display or an organic EL display, and an input device, such as an operation key or a touch panel arranged to overlap a screen of the display device. The operation display 52 displays various information on the display device, converts input operation by a user with respect to the input device into an operation signal, and outputs the operation signal to the controller 40.

The input/output interface 53 mediates transmission or reception of data between the external device 2 and the controller 40. The input/output interface 53 includes, for example, any one of or a combination of various serial interfaces and various parallel interfaces.

The external device 2 is, for example, a personal computer, and supplies a print job, image data, or the like to the controller 40 via the input/output interface 53.

Figure 4:
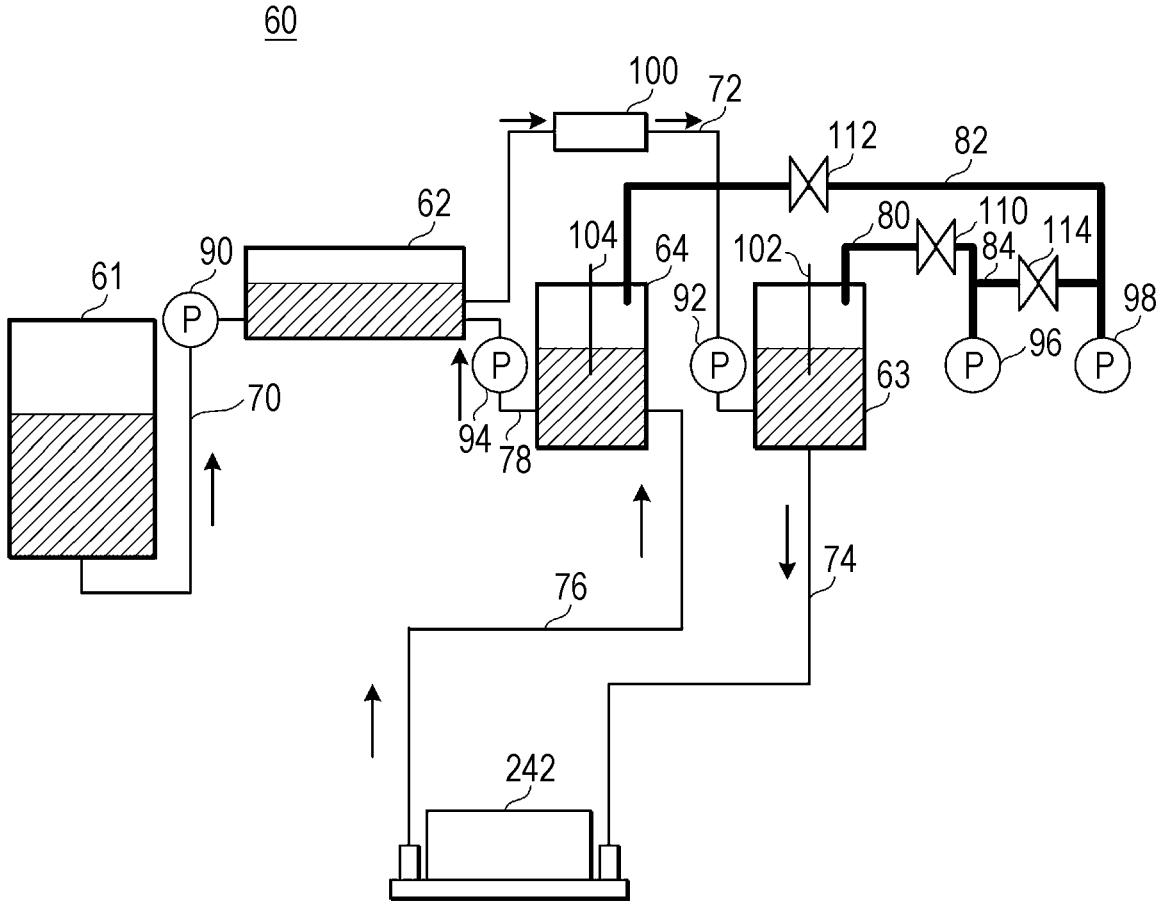
FIG. 4 is a diagram showing a configuration of an ink supply mechanism that supplies ink to an inkjet head.

Next, a configuration of an ink supply mechanism 60 that supplies ink to the inkjet head 242 in the inkjet image former 1 will be described with reference to FIG. 4. The ink supply mechanism 60 supplies ink to an inkjet head while circulating the ink among a supply tank that supplies ink, the inkjet head, and a collection tank that collects the ink. In FIG. 4, each of thin lines indicates an ink flow path through which ink flows, and each of thick lines indicates an air flow path through which air flows.

As shown in FIG. 4, the ink supply mechanism 60 includes a main tank 61, sub tanks 62, 63, 64, ink flow paths 70, 72, 74, 76, 78, air now paths 80, 82, 84, supply pumps 90, 92, 94, back pressure pumps 96, 98, a degassing module 100, liquid level detectors 102, 104, back pressure valves 110, 112, an electromagnetic valve 114, or the like. As the supply pumps 90, 92, 94, pumps including a backflow prevention function are used.

The sub tanks 63, 64 function as an "ink storage" according to the present invention. The back pressure pumps 96, 98 and back pressure valves 110, 112 function as a "pressure generator" according to the present invention. The air flow path 84 and electromagnetic valve 114 function as a "storage communicator" according to the present invention. The electromagnetic valve 114 functions as a "communication valve" according to the present invention.

The main tank 61 is provided outside the head units 24 and stores ink of colors (yellow (Y), magenta (M), cyan (C) and black (K)) corresponding to the respective head units 24. The ink stored in the main tank 61 is pumped out by the supply pump 90 that operates on the basis of a control signal supplied from the controller 40, and is supplied to the sub tank 62 via the ink flow path 70.

The sub tank 62 is connected to the ink flow paths 70, 72, 78 between the main tank 61 and the sub tanks 63, 64, and stores the ink pumped out from the main tank 61 and supplied. The ink stored in the sub lank 62 is pumped out by the supply pump 92 that operates on the basis of a control signal supplied from the controller 40, and is supplied to the sub tank 63 via the ink flow path 72.

The degassing module 100 is provided in a middle of the ink flow path 72. The degassing module 100 performs degassing processing for removing a bubble or dissolved gas from the ink supplied from the sub tank 62 to the sub tank 63.

The sub tank 63 (supply tank) is connected to the ink flow paths 72, 74 between the sub tank 62 and the inkjet head 242, and stores the ink pumped out from the sub tank 62 and supplied. In the present embodiment, a metal container having capacity of about 40 liters is used as the sub tank 63.

The sub tank 63 is provided with the liquid level detector 102 (liquid level detection sensor) that detects an ink liquid level in the sub tank 63. The liquid level detector 102 detects the ink liquid level in the sub tank 63, and outputs the detected ink liquid level to the controller 40.

When the ink liquid level detected by the liquid level detector 102 falls below a predetermined value, the ink stored in the sub tank 62 is pumped out by the supply pump 92 that operates on the basis of a control signal supplied from the controller 40, and is supplied to the sub tank 63 via the ink flow path 72.

A predetermined negative pressure is applied to the sub tank 63. Then, the ink stored in the sub tank 63 is supplied to the inkjet head 242 via the ink flow path 74 when an image is formed on the recording medium P. The inkjet head 242 ejects the ink supplied from the sub tank 63.

The sub tank 64 (collection tank) is connected to the ink flow paths 76, 78 between the sub tank 62 and the inkjet head 242, and stores the ink supplied from the inkjet head 242 via the ink flow path 76. In the present embodiment, a metal container having capacity of about 40 liters is used as the sub tank 64.

The sub tank 64 is provided with the liquid level detector 104 (liquid level detection sensor) that detects an ink liquid level in the sub tank 64. The liquid level detector 104 detects the ink liquid level in the sub tank 64, and outputs the detected ink liquid level to the controller 40.

When the ink liquid level detected by the liquid level detector 104 exceeds a predetermined value, the ink stored in the sub tank 64 is pumped out by the supply pump 94 that operates on the basis of a control signal supplied from the controller 40, and is supplied to the sub tank 62 via the ink flow path 78.

A predetermined negative pressure is applied to the sub tank 64. Of the ink supplied from the sub tank 63 to the inkjet head 242, ink not ejected from the inkjet head 242 is supplied (collected) to the sub tank 64 via the ink flow path 76 when an image is formed on the recording medium P.

Due to a difference in negative pressure applied to each of the sub tanks 63, 64 (a difference in internal pressure generated between the sub tanks 63, 64), the ink supplied from the sub tank 63 to the inkjet head 242 is guided to the sub tank 64. A flow rate of ink flowing to the inkjet head 242 is adjusted according to the difference in negative pressure applied to each of the sub tanks 63, 64.

Next, there will be described a specific configuration in which negative pressure is applied to the sub tanks 63, 64.

The sub tank 63 is connected to the back pressure pump 96 via an air flow path 80. The air flow path 80 is provided with the back pressure valve 110 that adjusts an amount of opening/closing the air flow path 80 on the basis of a control signal supplied from the controller 40.

Under control of the controller 40, the back pressure pump 96 (for example, a vacuum pump) sucks air in the sub tank 63 via the air flow path 80 to reduce pressure (atmospheric pressure) in the sub tank 63. Under the control of the controller 40 and according to a detection result from a pressure detector (not illustrated) that detects pressure in the air flow path 80, the back pressure valve 110 opens and closes the air flow path 80 so that a predetermined amount of pressure is maintained in the sub tank 63, thereby adjusting an amount of air sucked into the back pressure pump 96.

The sub tank 64 is connected to the back pressure pump 98 via an air flow path 82. The air flow path 82 is provided with the back pressure valve 112 that adjusts an amount of opening/closing the air flow path 82 on the basis of a control signal supplied from the controller 40.

Under control of the controller 40, the back pressure pump 98 (for example, a vacuum pump) sucks air in the sub tank 64 via the air flow path 82 to reduce pressure (atmospheric pressure) in the sub tank 64. Under control of the controller 40 and according to a detection result from a pressure detector (not illustrated) that detects pressure in the air flow path 82, the back pressure valve 112 opens and closes the air flow path 82, thereby adjusting an amount of air sucked into the back pressure pump 98, so that a predetermined amount of pressure is maintained in the sub tank 64.

As described above, as a result of back pressure having different magnitudes is applied to the sub tanks 63, 64 by drive control of the back pressure pumps 96, 98, a difference in internal pressure is generated between the sub tanks 63, 64, and ink flows from the sub tank 63 to the sub tank 64 via the inkjet head 242.

However, a difference in internal pressure remains between the sub tank 63 and the sub tank 64 in the above-described ink supply mechanism 60 in a case of an unexpected stop of the inkjet image former 1 (that is, a stop of drive control of either of the back pressure pumps 96, 98), such as an emergency stop of the inkjet image former 1 or an instantaneous power interruption (a power failure for a short time). As a result, there is a problem that the difference in internal pressure may cause a failure such as, for example, ink flowing out from the sub tank 63 (or the sub tank 64) to the air flow path 80 (or the air flow path 82), or ink leaking from a nozzle provided on an inkjet head 242.

Therefore, in the present embodiment, a configuration capable of preventing occurrence of a failure caused by an unexpected stop of the inkjet image former 1 is adopted in the ink supply mechanism 60.

That is, the ink supply mechanism 60 includes the air flow path 84 provided between the sub tanks 63, 64 (more specifically, the air flow paths 80, 82), and the electromagnetic valve 114 that communicates the sub tanks 61, 64 by opening the air flow path 84.

The electromagnetic valve 114 is provided in the air flow path 84, and is in a normally open state when not receiving power supply from the device power supply 120 (refer to FIG. 3) included in the inkjet image former (that is, when the inkjet image former 1 is stopped). When receiving power supply from the device power supply 120 (that is, when the inkjet image former 1 is in operation), the electromagnetic valve 114 switches a state of the air flow path 84 from open to closed on the basis of a control signal supplied from the controller 40.

Figure 5:
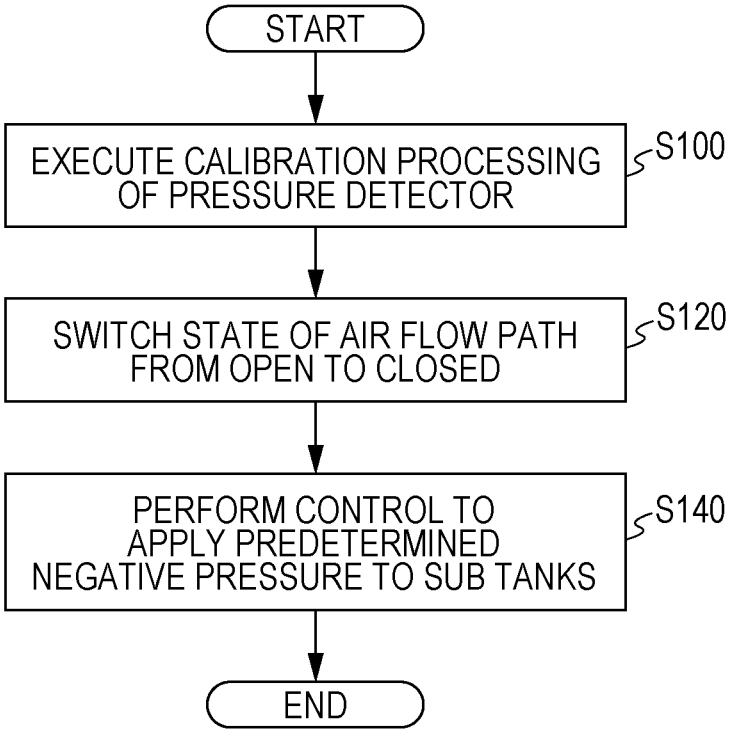
FIG. 5 is a flowchart showing an example of control operation of the inkjet image former.

Next, an example of control operation of the inkjet image former 1 will be described with reference to a flowchart in FIG. 5. Note that processing shown in FIG. 5 is executed after the power of the inkjet image former is turned on, and before image data related to a print job is supplied to the controller 40 and an ink droplet of an amount corresponding to a pixel value of the image data is ejected from each of the nozzles of the respective inkjet heads 242 (that is, before execution of the print job).

First, the controller 40 executes calibration processing of the pressure detector that detects pressure in the air flow paths 80, 82 as processing of preliminary preparation of applying a predetermined negative pressure to the sub tanks 63, 64 (step S100).

Next, to switch the state of the an flow path 84 from open to closed, the controller 40 supplies a control signal to the electromagnetic valve 114 receiving power supply from the device power supply 120 included in the inkjet image former 1 (step S120).

Finally, the controller 40 performs control to apply a predetermined negative pressure to the sub tanks 63, 64 (step S140). Specifically, the controller 40 controls the back pressure valve 110 to cause the back pressure valve 110 to adjust an amount of air sucked into the back pressure pump 96 by opening and closing the air flow path 80 according to a detection result from a pressure detector that detects pressure in the air flow path 80, so that a predetermined amount of pressure is maintained in the sub tank 63. In addition, the controller 40 controls the back pressure valve 112 to cause the back pressure valve 112 to adjust an amount of air sucked into the back pressure pinup 98 by opening and closing the air flow path 82 according to a detection result from a pressure detector that detects pressure in the air flow path 82, so that a predetermined amount of pressure is maintained in the sub tank 64. As a result, back pressure having different magnitudes is applied to the sub tanks 63, 64, a difference in internal pressure is generated between the sub tanks 63, 64, and ink flows from the sub tank 63 to the sub tank 64 via the inkjet head 242. Upon completion of the processing in step S140, the inkjet image former 1 ends the processing in FIG. 5.

Thereafter, in a case of an unexpected stop of the inkjet image former 1 (that is, a stop of drive control of the back pressure pumps 96, 98) during the print job, power supply from the device power supply 120 included in the inkjet image former 1 stops, and the electromagnetic valve 114 switches the state of the air flow path 84 from closed to open automatically. Thus, the air flow paths 80, 82 communicate with each other and therefore the sub tanks 63, 64 communicate with each other, and a difference in internal pressure between the sub tank 63 and the sub tank 64 decreases. As a result, the internal pressure in the sub tank 63 and the internal pressure in the sub tank 64 are equalized (that is, a difference in internal pressure does not remain between the sub tank 63 and the sub tank 64), preventing generation of a problem that the difference in internal pressure causes a failure such as, for example, ink flowing out from the sub tank 63 (or the sub tank 64) to the air flow path 80 (or the air flow path 82), or ink leaking from a nozzle provided on the inkjet head 242.

As described in detail above, the image former (inkjet image former 1) includes an inkjet head 242, a plurality of ink storages (sub tanks 63, 64) that is connected to the inkjet head 242 and stores ink, a pressure generator (back pressure pumps 96, 98 and back pressure valves 110, 112) that generates a difference in internal pressure between the plurality of ink storages so that ink flows between the plurality of ink storages and the inkjet head 242, and a storage communicator (air flow path 84 and electromagnetic valve 114) that causes the plurality of ink storages to communicate with each other so that the difference in internal pressure decreases.

According to the present embodiment configured as above, in a case of an unexpected stop of the inkjet image former 1, the storage communicator (air flow path 84 and the electromagnetic valve 114) can cause the plurality of ink storages (sub tanks 63, 64) to communicate with each other so that a difference in internal pressure between the plurality of ink storages decreases. Therefore, the internal pressure in the sub tank 63 and the internal pressure in the sub tank 64 are equalized (that is, a difference in internal pressure does not remain between the sub tank 63 and the sub tank 64), preventing generation of a problem that the difference in internal pressure causes a failure such as, for example, ink flowing out from the sub tank 63 (or the sub tank 64) to the air flow path 80 (or the air flow path 82), or ink leaking from a nozzle provided on the inkjet head 242.

In the above embodiment, there has been described an example in winch the electromagnetic valve 114 is in the normally open state when not receiving power supply from the device power supply 120 included in the inkjet image former 1 (that is, when the inkjet image former 1 is stopped). However, the present invention is not limited thereto. For example, the electromagnetic valve 114 may be in a normally closed state when not receiving power supply from the device power supply 120 included in the inkjet image former 1. In this case, when an unexpected stop of the inkjet image former 1 occurs, the electromagnetic valve 114 receives power supply from an emergency power supply 122 (refer to FIG. 3) different from the device power supply 120, and switches the state of the air flow path 84 from closed to open on the basis of a control signal supplied from the controller 40.

Figure 6:
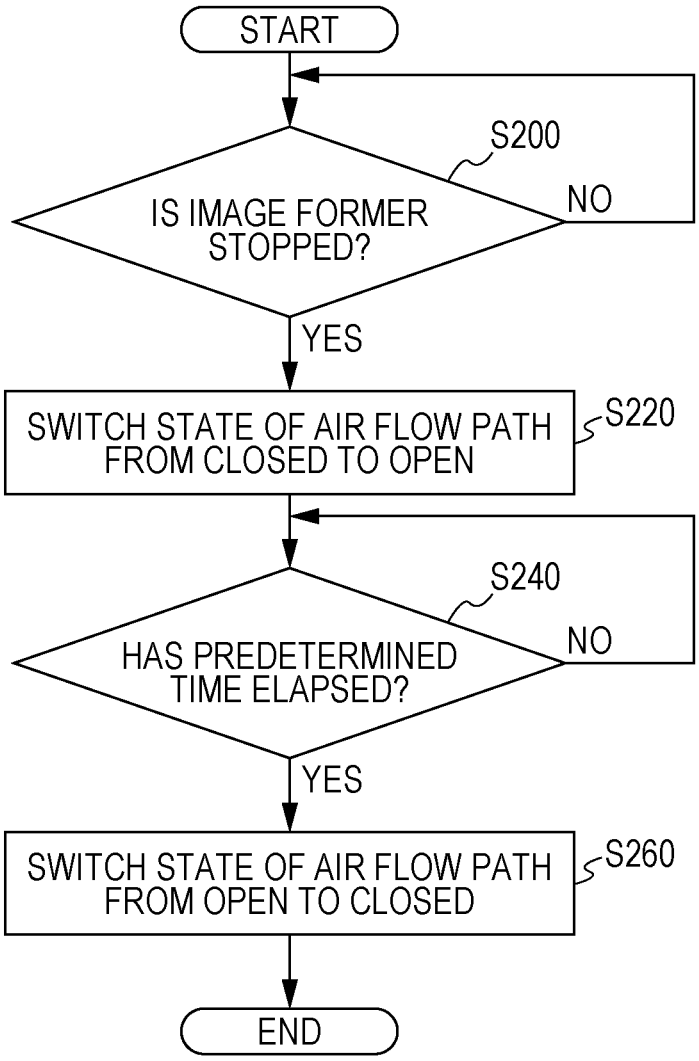
FIG. 6 is a flowchart showing an example of control operation of the inkjet image former.

Here, an example of control operation of the inkjet image former 1 in the above modification will be described with reference to a flowchart in FIG. 6. Note that processing shown in FIG. 6 is executed after the power of the inkjet image former 1 is turned on, and when image data related to a print job is supplied to the controller 40 and an ink droplet of an amount corresponding to a pixel value of the image data is ejected from each of the nozzles of the respective inkjet heads 242 (that is, during execution of the print job).

First, the controller 40 determines whether or not the device power supply 120 included in the inkjet image former 1 is stopped (that is, whether or not the inkjet image former 1 is stopped) (step S200).

In a case where the device power supply 120 is not stopped (NO in step S200) as a result of the determination, the processing returns to before step S200. Meanwhile, in a case where the device power supply 120 is stopped (YES in step S200), the controller 40 causes the emergency power supply 122 to supply power to the electromagnetic valve 114, and supplies a control signal to the electromagnetic valve 114 to switch the state of the air flow path 84 from closed to open (step S220).

Next, the controller 40 determines whether or not a predetermined time has elapsed since the state of the air flow path 84 was switched from closed to open (step S240). The predetermined time is, for example, 5 seconds which is presumed to be required for the sub tanks 63, 64 to communicate with each other and for the internal pressure of the sub tank 63 and the internal pressure of the sub tank 64 to be equalized.

In a case where the predetermined time has not elapsed (NO in step S240) as a result of the determination, the processing returns to before step S240. Meanwhile, in a case where the predetermined time has elapsed (YES in step S240), the controller 40 causes the emergency power supply 122 to supply power to the electromagnetic valve 114, and supplies a control signal to the electromagnetic valve 114 to switch the state of the air flow path 84 from open to closed (step S260). Upon completion of the processing in step S260, the inkjet image former 1 ends the processing in FIG. 6.

In the above-described modification also, in a case of an unexpected stop of the inkjet image former 1, the storage communicator (air flow path 84 and the electromagnetic valve 114) can cause the plurality of ink storages (sub tanks 63, 64) to communicate with each other so that a difference in internal pressure between the plurality of ink storages decreases. Therefore, the internal pressure in the sub tank 63 and the internal pressure in the sub tank 64 are equalized (that is, a difference in internal pressure does not remain between the sub tank 63 and the sub tank 64), preventing generation of a problem that the difference in internal pressure causes a failure such as, for example, ink flowing out from the sub tank 63 (or the sub tank 64) to the air flow path 80 (or the air flow path 82), or ink leaking from a nozzle provided on the inkjet head 242.

In the above-described embodiment, even in a case where the inkjet image former 1 is not stopped, the sub tank 63 and the sub tank 64 may be caused to communicate with each other when the amount of ink stored in the sub tank 63 (or the sub tank 64) is equal to or more than a predetermined amount (specifically, an amount of ink having a level corresponding to an ink liquid level at which the ink may overflow from the sub tanks 63, 64 into the air flow paths 80, 82) on the basis of a detection result from the liquid level detectors 102, 104. Thus, for example, even in a case where a proper back pressure cannot be applied to the sub tanks 63, 64 due to a malfunction of the pressure detector and a difference in internal pressure remains between the sub tank 63 and the sub tank 64, it is possible to prevent occurrence of a failure such as ink flowing out from the sub tank 63 (or the sub tank 64) to the air flow path 80 (or the air flow path 82).

In the above embodiment, the inkjet image former 1 of a single pass type has been described as an example. However, the present invention may be applied to an inkjet image former that records an image while scanning a head unit. Further, the present invention may be applied to an inkjet image former in which a head unit is provided with a single nozzle.

Although embodiments of the present invention have been described and illustrated in detail, the disclosed embodiments are made for purposes of illustration and example only and not limitation. That is, the 21) present invention can be implemented in various forms without departing from the gist or main features thereof. The scope of the present invention should be interpreted by terms of the appended claims.

What is claimed is:

1. An image former comprising:

an inkjet head;

a plurality of ink storages that is connected to the inkjet head and stores ink;

a pressure generator configured to suck air from at least one of the plurality of ink storages to generate a difference in internal pressure between the plurality of ink storages so that ink flows between the plurality of ink storages and the inkjet head; and a storage communicator that causes the plurality of ink storages to communicate with each other so that the difference in internal pressure decreases, wherein the storage communicator includes an air flow path provided between the plurality of ink storages, and a communication valve that causes the plurality of ink storages to communicate with each other by opening the air flow path, the communication valve opens the air flow path when the image former is stopped, the image former further comprises a device power supply, and the communication valve closes the air flow path when receiving power supply from the device power supply included in the image former, while the communication valve opens the air flow path when not receiving power supply from the device power supply.

2. The image former according to claim 1, wherein the air flow path is connected to the pressure generator.

3. The image former according to claim 1, wherein the storage communicator causes the plurality of ink storages to communicate with each other when an amount of ink stored in one of the plurality of ink storages is equal to or more than a predetermined amount.

4. An image former comprising:

an inkjet head;

a plurality of ink storages that is connected to the inkjet head and stores ink;

a pressure generator configured to suck air from at least one of the plurality of ink storages to generate a difference in internal pressure between the plurality of ink storages so that ink flows between the plurality of ink storages and the inkjet head; and a storage communicator that causes the plurality of ink storages to communicate with each other so that the difference in internal pressure decreases, wherein the storage communicator includes an air flow path provided between the plurality of ink storages, and a communication valve that causes the plurality of ink storages to communicate with each other by opening the air flow path, the communication valve opens the air flow path when the image former is stopped, and the communication valve opens the air flow path by receiving power supply from an emergency power supply when the image former is stopped.

* * * * *